US006987231B2

(12) United States Patent
Schmon et al.

(10) Patent No.: US 6,987,231 B2
(45) Date of Patent: Jan. 17, 2006

(54) MULTIFUNCTIONAL PUSHBUTTON SWITCH

(75) Inventors: Wilfried Schmon, Messkirch (DE); Markus Altmann, Moos (DE); Peter Schulte, Moos (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 75 days.

(21) Appl. No.: 10/634,720

(22) Filed: Aug. 5, 2003

(65) Prior Publication Data

US 2004/0089530 A1 May 13, 2004

(30) Foreign Application Priority Data

Aug. 8, 2002 (DE) ..... 202 12 254 U

(51) Int. Cl.
*H04H 9/00* (2006.01)

(52) U.S. Cl. ..... 200/61.54; 200/5 A

(58) Field of Classification Search ... 200/61.54–61.57, 200/512, 5 A, 5 R, 302.2, 314, 302.1, 2
See application file for complete search history.

(56) References Cited

U.S. PATENT DOCUMENTS 4,638,131 A * 1/1987 Kidd et al. ..... 200/61.55
4,766,271 A * 8/1988 Mitsuhashi et al. ..... 200/512
4,975,547 A * 12/1990 Nakayama et al. ..... 200/5 R
5,542,694 A * 8/1996 Davis ..... 200/61.54
5,630,617 A * 5/1997 Hashiba ..... 280/731
5,689,095 A * 11/1997 Kawase ..... 200/5 R
5,855,392 A * 1/1999 Simpson et al. ..... 200/61.54
6,225,578 B1 * 5/2001 Kobayashi et al. ..... 200/5 R

FOREIGN PATENT DOCUMENTS

| | | |
|---|---|---|
| DE | 3441129 | 5/1986 |
| DE | 4016122 | 11/1990 |
| DE | 4111680 | 10/1992 |
| DE | 19640684 | 4/1998 |
| DE | 19653166 | 6/1998 |
| DE | 19740382 | 3/1999 |
| DE | 10112006 | 9/2001 |
| FR | 2587833 | 3/1987 |
| GB | 2168537 | 6/1986 |
| GB | 2353762 | 3/2001 |

* cited by examiner

*Primary Examiner*—Lincoln Donovan
*Assistant Examiner*—M. Fishman
(74) *Attorney, Agent, or Firm*—Tarolli, Sundheim, Covell & Tummino L.L.P.

(57) ABSTRACT

A multifunctional pushbutton switch for a vehicle steering wheel has a plurality of pushbutton switching units that have pushbutton surfaces located close to each other in a shared operating surface. The switch has a shared switch housing in which actuation tappets of the pushbutton switching units are movably guided, and a cap mounted over the actuation tappets and onto the switch housing. The cap is made by means of a two-component injection-molding technique and consists of a relatively rigid plastic frame with recessed windows each of a shape and size that corresponds to the circumference of one of the pushbutton surfaces and of a silicone membrane extending over the recessed windows.

8 Claims, 3 Drawing Sheets

10
20
24
21
22
23
30
16
A
28
26
16
28
32
17

MULTIFUNCTIONAL PUSHBUTTON SWITCH

FIELD OF THE INVENTION

The invention relates to a multifunctional pushbutton switch with several pushbutton switching units whose pushbutton surfaces are close to each other in a shared operating surface, especially for a vehicle steering wheel, with a shared switch housing in which the actuation tappets of the pushbutton switching units are configured so that they can move.

BACKGROUND OF THE INVENTION

With multifunctional pushbutton switches, especially in multifunction steering wheels for vehicles, the individual pushbutton switches are grouped next to each other and they project individually from openings of a cover. As a result, they can be felt and operated without visual contact. The assembly of such a multifunctional pushbutton switch, however, is highly complex.

BRIEF SUMMARY OF THE INVENTION

The invention provides a multifunctional pushbutton switch that can be visually and functionally well integrated into an existing environment, especially into the steering wheel of a vehicle. The multifunctional pushbutton switch according to the invention has a cap that is made by means of a two-component injection-molding technique and that is mounted onto the actuation tappets and onto the switch housing. The cap consists of a relatively rigid plastic frame with cutout windows whose shape and size each correspond to the circumference of one of the pushbutton surfaces and consists of a silicone membrane stretched over the windows. In this manner, the multifunctional pushbutton switch has a completely contiguous operating surface that is formed by the outer surface of the silicone membrane. The actuation tappets of the pushbutton switching units can be felt through the silicone membrane and can be actuated by pressure exerted on the outer surface of the silicone membrane. The silicone membrane preferably extends continuously over the entire outer surface of the cap, which is integrated into the surface of the steering wheel body.

In the case of multifunctional pushbutton switches whose individual pushbutton surfaces lie closely adjacent to each other, the possibility exists that several pushbuttons might be actuated at the same time. This can be prevented if, according to an embodiment of the invention, the individual pushbutton surfaces of the pushbutton switching units are delineated by a star-shaped or cross-shaped support structure that is formed in one piece with the plastic frame. The actuation tappets are preferably pressed resiliently against the inner surface of the silicone membrane, but are retained by stop members in their unactuated resting positions. These stop members are formed by lateral projections that are molded onto the actuation tappets and that interact with the surface of the support structure that faces away from the silicone membrane and that is covered with a layer of silicone material. The multifunctional pushbutton switch preferably has an altogether convex operating surface.

BRIEF DESCRIPTION OF THE SEVERAL VIEWS OF THE DRAWINGS

Additional features and advantages of the invention ensue from the following description of a preferred embodiment and from the drawing to which reference is made. The drawing shows the following.

DETAILED DESCRIPTION OF THE INVENTION

Figure 1:
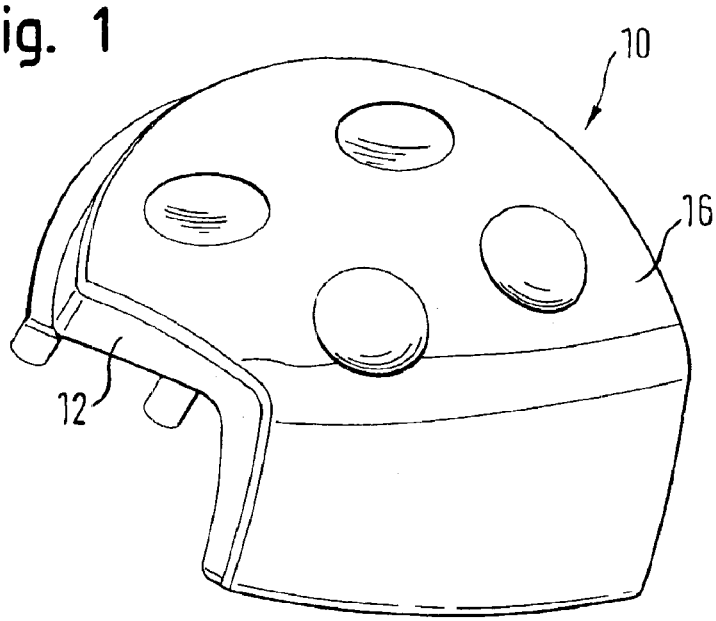
FIG. 1 a perspective view of a cap.
Figure 2:
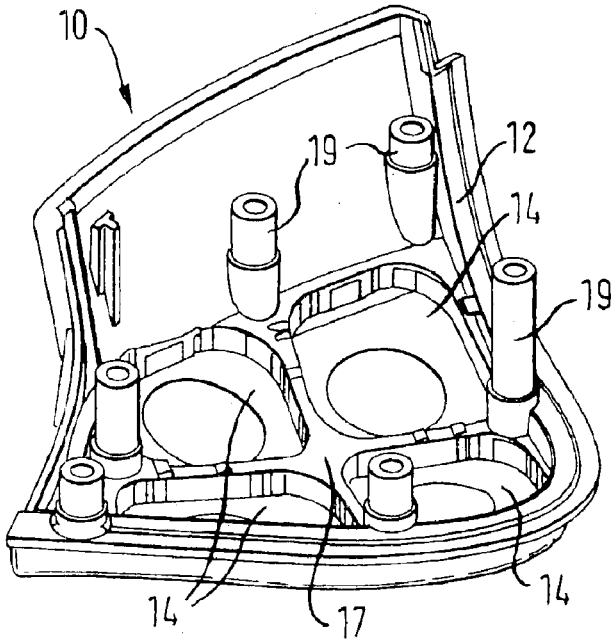
FIG. 2 a top view of the inside of a cap.

The cap of a multifunctional pushbutton switch generally designated with the reference numeral 10 in FIGS. 1 and 2 has a frame 12 made of relatively rigid plastic from which windows 14 are cut out, over which a silicone membrane 16 is stretched. The silicone membrane 16 forms a completely contiguous operating surface on the outer surface of the cap. The windows 14 are delineated from each other by a cross-shaped support structure 17 that is formed in one piece with the plastic frame 12. Moreover, fastening domes 19 are shaped onto the plastic frame 12.

Figures 3, 3A:
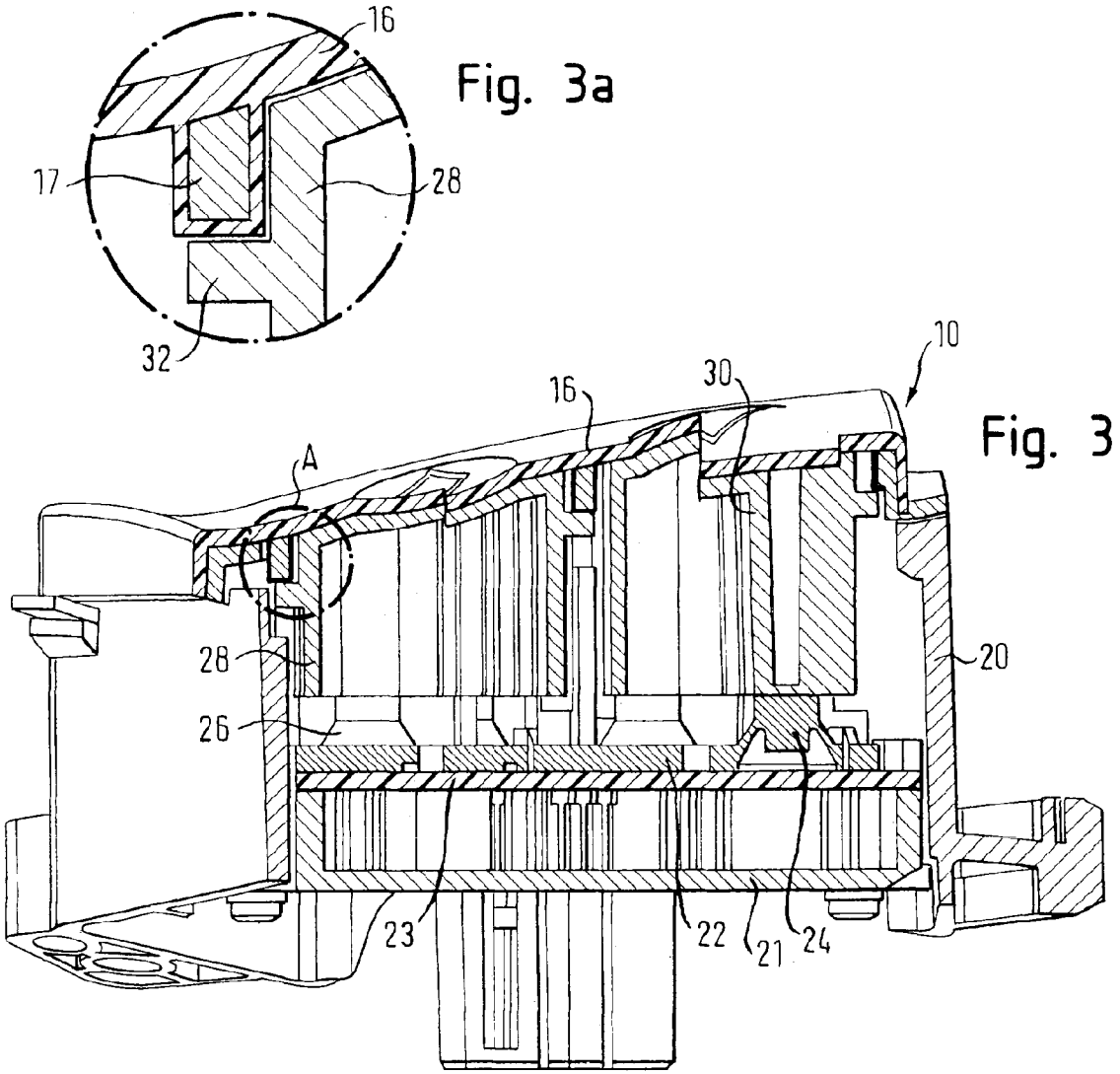
FIG. 3 a sectional view of a multifunctional pushbutton switch.
FIG. 3*a* a detailed view from FIG. 3.
Figure 4:
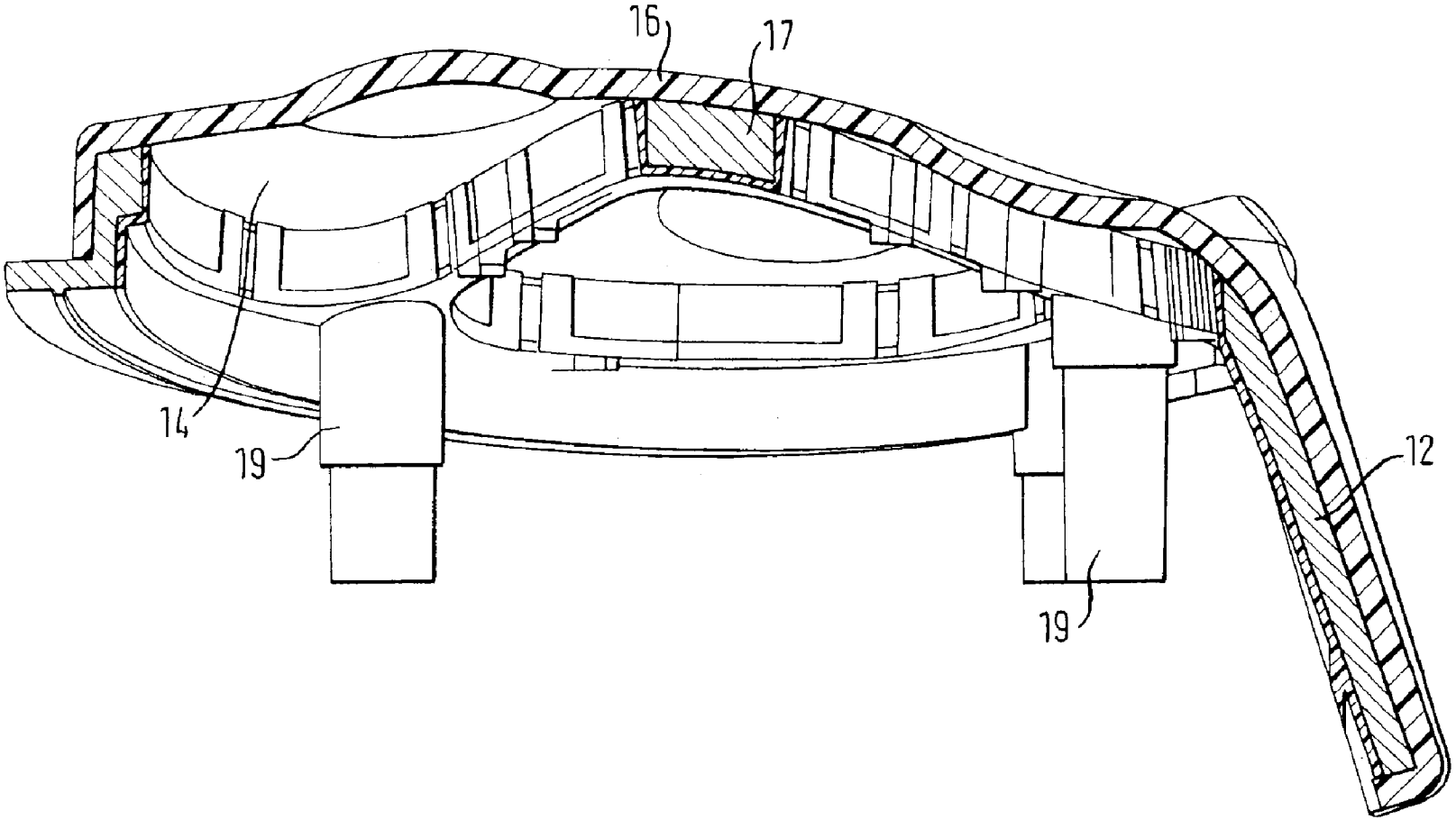
FIG. 4 a sectional view of the cap of the multifunctional pushbutton switch.

FIG. 3 shows a switch housing 20 onto which the cap 10 has been placed. A baseplate 21 that has a switching mat 22 on a printed circuit board 23 is inserted into the switch housing 20. The switching mat 22 has shaped-in domes with contact tabs as movable contacts 24, 26 that are each actuated by an actuation tappet 28 or 30. Of the total of four actuation tappets of the multifunctional pushbutton switch, only the actuation tappets 28 and 30 can be seen in FIG. 2. The actuation tappets 28, 30 are pressed from the inside against the silicone membrane 16, giving it a convex curvature. On its actuation surface lying against the inner surface of the silicone membrane 16, two of the total of four actuation tappets 28, 30 have a concave form that can be felt through the membrane. The other two actuation surfaces can be convex.

The actuation tappets 28, 30 are provided with lateral projections 32 that project underneath the support structure 17 and that come to rest against the underside of the support structure 17 that is covered with a layer of silicone material, as long as the appertaining actuation tappet is not actuated. The stop noise is muffled by the silicone material.

The cap 10 consisting of the frame 12 and of the silicone membrane 16 is configured as a two-component injection-molded part. The outer surface of the frame 12 is completely covered by a continuous layer of silicone material. Between the material of the frame 12 and the layer of silicone material, there is a bonded connection that can be mechanically stressed and that is splash-proof. Since the layer of silicone material surrounds the frame 12 on its outer circumference, there is also a positive connection that further increases the mechanical stressability. Moreover, this creates not only a completely contiguous operating surface over the actuation tappets, but also a visually attractive appearance. If the operating surface is to be labeled, for example, with symbols indicating the function of the individual pushbutton switches, then a high positional accuracy is ensured since the rigid frame 12 cannot shift with respect to the silicone layer that covers it. In this case, the operating surface is preferably provided in symbol color and then coated in a dark color; the symbols are cut out from the dark coating layer by means of a laser beam.

What is claimed is:

1. A multifunctional pushbutton switch with a plurality of pushbutton switching units that have pushbutton surfaces located close to each other in a shared operating surface, comprising a shared switch housing in which actuation tappets of the pushbutton switching units are movably guided, and a cap mounted over the actuation tappets and onto the switch housing, said cap being made by means of a two-component injection-molding technique and comprising a relatively rigid plastic frame with recessed windows each of a shape and size that corresponds to the circumference of one of the pushbutton surfaces and of a silicone membrane extending over the recessed windows, and a support structure that has a layer of silicone material on its side facing away from the silicone membrane, said layer forming an abutment that interacts with corresponding stop surfaces on the actuation tappets.

2. The multifunctional pushbutton switch according to claim 1, wherein the support structure is a cross-shaped or star-shaped support structure formed in one piece with the plastic frame to extend between the recessed windows.

3. The multifunctional pushbutton switch according to claim 1, wherein the actuation tappets are pressed resiliently against the inner surface of the silicone membrane and are retained by stop members in unactuated resting positions.

4. The multifunctional pushbutton switch according to claim 1, wherein the shared operating surface formed by the outer surface of the silicone membrane has an altogether convex curvature.

5. The multifunctional pushbutton switch according to claim 1, wherein the actuation tappets have a projection or indentation that can be felt through the silicone membrane a nd is formed on an operating surface that lies against the inner surface of the silicone membrane.

6. The multifunctional pushbutton switch according to claim 1, wherein the plastic frame and the silicone membrane are joined with an inter-material bond.

7. The multifunctional pushbutton switch according to claim 6, wherein the silicone membrane engages behind the outer circumference of the plastic frame with a form fit.

8. A multifunctional pushbutton switch with a plurality of pushbutton switching units that have pushbutton surfaces located close to each other in a shared operating surface, comprising a shared switch housing in which actuation tappets of the pushbutton switching units are movably guided, and a cap mounted over the actuation tappets and onto the switch housing, said cap being made by means of a two-component injection-molding technique and comprising a relatively rigid plastic frame with recessed windows each of a shape and size that corresponds to the circumference of one of the pushbutton surfaces and of a silicone membrane extending over the recessed windows, and said plastic frame and said silicone membrane are joined with an inter-material bond.

* * * * *

UNITED STATES PATENT AND TRADEMARK OFFICE

CERTIFICATE OF CORRECTION

PATENT NO. : 6,987,231 B2
APPLICATION NO. : 10/634720
DATED : January 17, 2006
INVENTOR(S) : Wilfried Schmon et al.

It is certified that error appears in the above-identified patent and that said Letters Patent is hereby corrected as shown below:

Column 4, line 3, after “membrane” delete “a” and insert --and--.

Column 4, line 4, before “is” delete --nd--.

Signed and Sealed this

First Day of August, 2006

JON W. DUDAS
*Director of the United States Patent and Trademark Office*